US011022351B2

(12) United States Patent
Sishtla et al.

(10) Patent No.: US 11,022,351 B2
(45) Date of Patent: Jun. 1, 2021

(54) LIQUID SENSING FOR REFRIGERANT-LUBRICATED BEARINGS

(71) Applicant: Carrier Corporation, Jupiter, FL (US)

(72) Inventors: Vishnu M. Sishtla, Manlius, NY (US); Scott A. Nieforth, Clay, NY (US)

(73) Assignee: Carrier Corporation, Palm Beach Gardens, FL (US)

( * ) Notice: Subject to any disclaimer, the term of this patent is extended or adjusted under 35 U.S.C. 154(b) by 93 days.

(21) Appl. No.: 15/739,221

(22) PCT Filed: Aug. 4, 2016

(86) PCT No.: PCT/US2016/045474

§ 371 (c)(1),
(2) Date: Dec. 22, 2017

(87) PCT Pub. No.: WO2017/024101

PCT Pub. Date: Feb. 9, 2017

(65) Prior Publication Data

US 2018/0180333 A1 Jun. 28, 2018

Related U.S. Application Data

(60) Provisional application No. 62/201,064, filed on Aug. 4, 2015.

(51) Int. Cl.
*F25B 31/00* (2006.01)
*F25B 1/053* (2006.01)
(Continued)

(52) U.S. Cl.
CPC ..... *F25B 31/002* (2013.01); *F25B 1/053* (2013.01); *F25B 1/10* (2013.01); *F25B 41/40* (2021.01);
(Continued)

(58) Field of Classification Search
CPC . F25B 31/002; F25B 2500/16; F25B 2700/04
See application file for complete search history.

(56) References Cited

U.S. PATENT DOCUMENTS 2,604,500 A 7/1952 Koning
2,768,511 A 10/1956 Moody
(Continued)

FOREIGN PATENT DOCUMENTS

CN 103062968 A 4/2013
EP 1614982 A2 1/2006
(Continued)

OTHER PUBLICATIONS

David C. Brondum et al., "High-Speed, Direct-Drive Centrifugal Compressors for Commercial HVAC Systems," presented at the 1998 International Compressor Conference at Purdue, 1998.
(Continued)

*Primary Examiner* — Marc E Norman
*Assistant Examiner* — Schyler S Sanks
(74) *Attorney, Agent, or Firm* — Bachman & LaPointe, P.C.

(57) ABSTRACT

A vapor compression system comprises a compressor (22). The compressor comprises an inlet (40) and an outlet (42) and an electric motor (28). The motor has a stator (30) and a rotor (32). A plurality of bearings (36) support the rotor. A fluid flowpath (126) extends to the plurality of bearings. A branch (310) from the fluid flowpath extends to the compressor. A liquid sensor (330) is along the branch.

22 Claims, 3 Drawing Sheets

(51) Int. Cl.
*F25B 1/10* (2006.01)
*F25B 41/40* (2021.01)

(52) U.S. Cl.
CPC ..... *F25B 2500/16* (2013.01); *F25B 2500/27* (2013.01); *F25B 2700/04* (2013.01)

(56) References Cited

U.S. PATENT DOCUMENTS

| | | | | |
|---|---|---|---|---|
| 2,986,905 | A | 6/1961 | Kocher et al. | |
| 3,150,277 | A | 9/1964 | Chubb et al. | |
| 3,158,009 | A | 11/1964 | Rayner | |
| 3,218,825 | A | 11/1965 | McClure | |
| 3,232,074 | A | 2/1966 | Weller et al. | |
| 3,300,997 | A | 1/1967 | Kocher | |
| 3,416,330 | A | 12/1968 | Weller et al. | |
| 3,695,485 | A * | 10/1972 | Littlejohn | B41F 7/24 222/68 |
| 3,805,547 | A | 4/1974 | Eber | |
| 5,469,713 | A | 11/1995 | Wardle et al. | |
| 5,881,564 | A * | 3/1999 | Kishimoto | F04D 27/0292 62/193 |
| 5,884,498 | A | 3/1999 | Kishimoto et al. | |
| 6,065,297 | A | 5/2000 | Tischer et al. | |
| 6,131,471 | A * | 10/2000 | Okoren | F04B 39/0207 340/609 |
| 6,564,560 | B2 | 5/2003 | Butterworth et al. | |
| 8,156,757 | B2 | 4/2012 | Doty et al. | |
| 8,434,323 | B2 | 5/2013 | Welch et al. | |
| 2001/0037651 | A1 * | 11/2001 | Butterworth | F04D 29/023 62/193 |
| 2013/0091880 | A1 * | 4/2013 | Inadomi | F25B 1/00 62/119 |
| 2014/0363311 | A1 | 12/2014 | Schreiber | |
| 2015/0354863 | A1 * | 12/2015 | Jandal | F25B 31/002 62/115 |

FOREIGN PATENT DOCUMENTS

| | | | |
|---|---|---|---|
| WO | 99/13225 | A1 | 3/1999 |
| WO | 2014/117012 | A1 | 7/2014 |
| WO | 2014/158329 | A1 | 10/2014 |
| WO | 2014/179032 | A1 | 11/2014 |

OTHER PUBLICATIONS

D.R. Pandy et al., "Innovative, Small, High-Speed Centrifugal Compressor Technologies," presented at the 1996 International Compressor Engineering conference at Purdue, Jul. 1996.

V.M. Sishtla, "Design and Testing of an Oil-Free Centrifugal Water-Cooled Chiller", International Conference on Compressors and their Systems: Sep. 13-15, 1999, City University, London, UK, conference transactions, The Institution of Mechanical Engineers, 1999, pp. 505-521.

International Search Report and Written Opinion dated Oct. 20, 2016 for PCT Patent Application No. PCT/US2016/045474.

Chinese Office Action dated Dec. 18, 2019 for Chinese Patent Application No. 201680038697.9.

Chinese Office Action dated Aug. 12, 2020 for Chinese Patent Application No. 201680038697.9.

* cited by examiner

LIQUID SENSING FOR REFRIGERANT-LUBRICATED BEARINGS

CROSS-REFERENCE TO RELATED APPLICATION

Benefit is claimed of U.S. Patent Application No. 62/201,064, filed Aug. 4, 2015, and entitled "Liquid Sensing for Refrigerant-Lubricated Bearings", the disclosure of which is incorporated by reference herein in its entirety as if set forth at length.

BACKGROUND

The disclosure relates to compressor lubrication. More particularly, the disclosure relates to centrifugal compressor lubrication.

A typical centrifugal chiller operates with levels of lubricant at key locations in flowing refrigerant. The presence of an oil reservoir, typically with more than a kilogram of oil will cause an overall content of oil to exceed 1.0 percent by weight when the oil accumulation in the reservoir is added to the numerator and denominator of the fraction. The concentration will be relatively low in the condenser (e.g., 50 ppm to 500 ppm). At other locations, the concentrations will be higher. For example the oil sump may have 60+ percent oil. This oil-rich portion is used to lubricate bearings. Thus, flow to the bearings will typically be well over 50 percent oil. At one or more locations in the system, strainers, stills, or other means may be used to withdraw oil and return it to a reservoir. It is desirable to remove the oil from locations where it may interfere with heat transfer or other operations.

There has for a long time existed a desire to operate chiller compressors and other rotating machinery and pumps without the need for a dedicated oil system. David C. Brondum, D. C., James E. Materne, J. E., Biancardi, F. R., and Pandy, D. R., "High-Speed, Direct-Drive Centrifugal Compressors for Commercial HVAC Systems," presented at the 1998 International Compressor Conference at Purdue, 1998; Pandy, D. R. and Brondum, D., "Innovative, Small, High-Speed Centrifugal Compressor Technologies," presented at the 1996 International Compressor Engineering conference at Purdue, July, 1996; Sishtla, V. M., "Design and Testing of an Oil-Free Centrifugal Water-Cooled Chiller", International Conference on Compressors and their Systems: 13-15 Sep. 1999, City University, London, UK, conference transactions, The Institution of Mechanical Engineers, 1999, pp. 505-521. In these tests, ceramic balls were used as the rolling element.

Jandal et al., WO2014/117012 A1, published Jul. 31, 2014, discloses a refrigerant-lubricated compressor. With such compressors, it is important that relatively high quality (high liquid fraction) refrigerant be delivered to the bearings.

SUMMARY

One aspect of the disclosure involves a vapor compression system comprising a compressor. The compressor comprises: an inlet and an outlet; and an electric motor. The motor has a stator and a rotor. A plurality of bearings support the rotor. A fluid flowpath extends to the plurality of bearings. A branch from the fluid flowpath extends to the compressor. A liquid sensor is along the branch.

In one or more embodiments of any of the foregoing embodiments, the liquid sensor may be along the branch spaced locally above the fluid flowpath.

In one or more embodiments of any of the foregoing embodiments, the liquid sensor may be an optical sensor.

In one or more embodiments of any of the foregoing embodiments, the liquid sensor may have a glass prism exposed to fluid along the branch.

In one or more embodiments of any of the foregoing embodiments, the branch may extend from the fluid flowpath directly back to the compressor.

In one or more embodiments of any of the foregoing embodiments, a degas tank may have an inlet and an outlet along the fluid flowpath. The liquid sensor may be mounted on the degas tank above the degas tank outlet.

In one or more embodiments of any of the foregoing embodiments, the liquid sensor may be mounted centered at least 25 mm above the outlet of the degas tank.

In one or more embodiments of any of the foregoing embodiments, the liquid sensor may be mounted generally horizontally.

In one or more embodiments of any of the foregoing embodiments, the liquid sensor may be a liquid level switch.

In one or more embodiments of any of the foregoing embodiments, the liquid level switch may be configured to have a closed condition associated with a sufficient liquid exposure.

In one or more embodiments of any of the foregoing embodiments, the compressor may be a centrifugal compressor comprising an impeller and the branch may extend to upstream of the impeller.

In one or more embodiments of any of the foregoing embodiments, the compressor may be a centrifugal compressor comprising inlet guide vanes and the branch may extend to downstream of the inlet guide vanes.

In one or more embodiments of any of the foregoing embodiments, the vapor compression system further comprises a condenser and an evaporator. A suction line is along a flowpath between the evaporator and an inlet of a first stage of the compressor. A flowpath leg extends from a discharge of the first stage to a second stage inlet. A discharge line is along a flowpath between a discharge of the second stage and an inlet of the condenser.

In one or more embodiments of any of the foregoing embodiments, a refrigerant charge of the system is one or more of: essentially oil-free; and at least 50% by weight trans 1-chloro, 3,3,3-fluoropropene (R1233zd(E)).

In one or more embodiments of any of the foregoing embodiments, the vapor compression system may lack an oil reservoir.

In one or more embodiments of any of the foregoing embodiments, a method for using the system comprises running the compressor; and responsive to an insufficiency of liquid detected by the liquid sensor, shutting down the compressor.

In one or more embodiments of any of the foregoing embodiments, the method further comprises during the running, drawing vapor along the branch.

In one or more embodiments of any of the foregoing embodiments, the compressor may be a centrifugal compressor comprising an impeller and the branch may extend to upstream of the impeller.

Another aspect of the disclosure involves a vapor compression system comprising a compressor. The compressor comprises an inlet and an outlet and an electric motor having: a stator; and a rotor; a plurality of bearings supporting the rotor. A fluid flowpath extends to the plurality of bearings. A liquid sensor is on a degas tank.

In one or more embodiments of any of the foregoing embodiments, the liquid sensor may be spaced locally above the flowpath.

In one or more embodiments of any of the foregoing embodiments, the liquid sensor may be a liquid level switch.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

It is desirable to ensure sufficient liquid refrigerant is delivered to the bearings. This may present issues of both flow rate and quality of refrigerant (e.g., the volume fraction of liquid flowing in the supply line). A sensor may be used configured to detect liquid, detect the absence of a liquid, or otherwise discriminate between the two. One example of a sensor involves optical measurement.

An exemplary baseline system locates the liquid sensor immediately along a supply line supplying refrigerant to the bearings. In one example, the supply line may be generally horizontal and the liquid sensor may be mounted generally atop the line (e.g., having an optical port along an upper portion of the line). This may be insufficient to provide a desired sensitivity to maintain sufficiently high refrigerant quality.

A system which, in some implementations, may be modified from such a baseline involves means for concentrating vapor proximate the sensor to improve effective sensor sensitivity. Exemplary means comprises a branch off of the refrigerant supply flowpath. To concentrate vapor in the branch, the branch extends upward from the supply flowpath. The exemplary sensor may be located along a side of the branch. Low density of vapor will allow vapor to concentrate in the branch above the liquid. Although the branch may be a blind branch, the exemplary configurations below vent the branch by connecting the branch to a low pressure location such as between the inlet guide vanes and to impeller of a centrifugal compressor. The greater the amount of vapor in the refrigerant supply flow, the greater the amount that can pass into the branch. In an equilibrium condition, more vapor in the flow will lead to more vapor in the branch and thus a lower level of the surface or the liquid in the branch. The height of the surface may thus be used as a proxy for the amount of vapor in the flow. A liquid level sensor at a given height in the branch may thus serve as a proxy for a sensor along the line intended to indicate a particular concentration of vapor. Although 100% liquid in the supply line is desirable, a target may be at least 95% liquid by volume or at least 98%.

Figure 1:
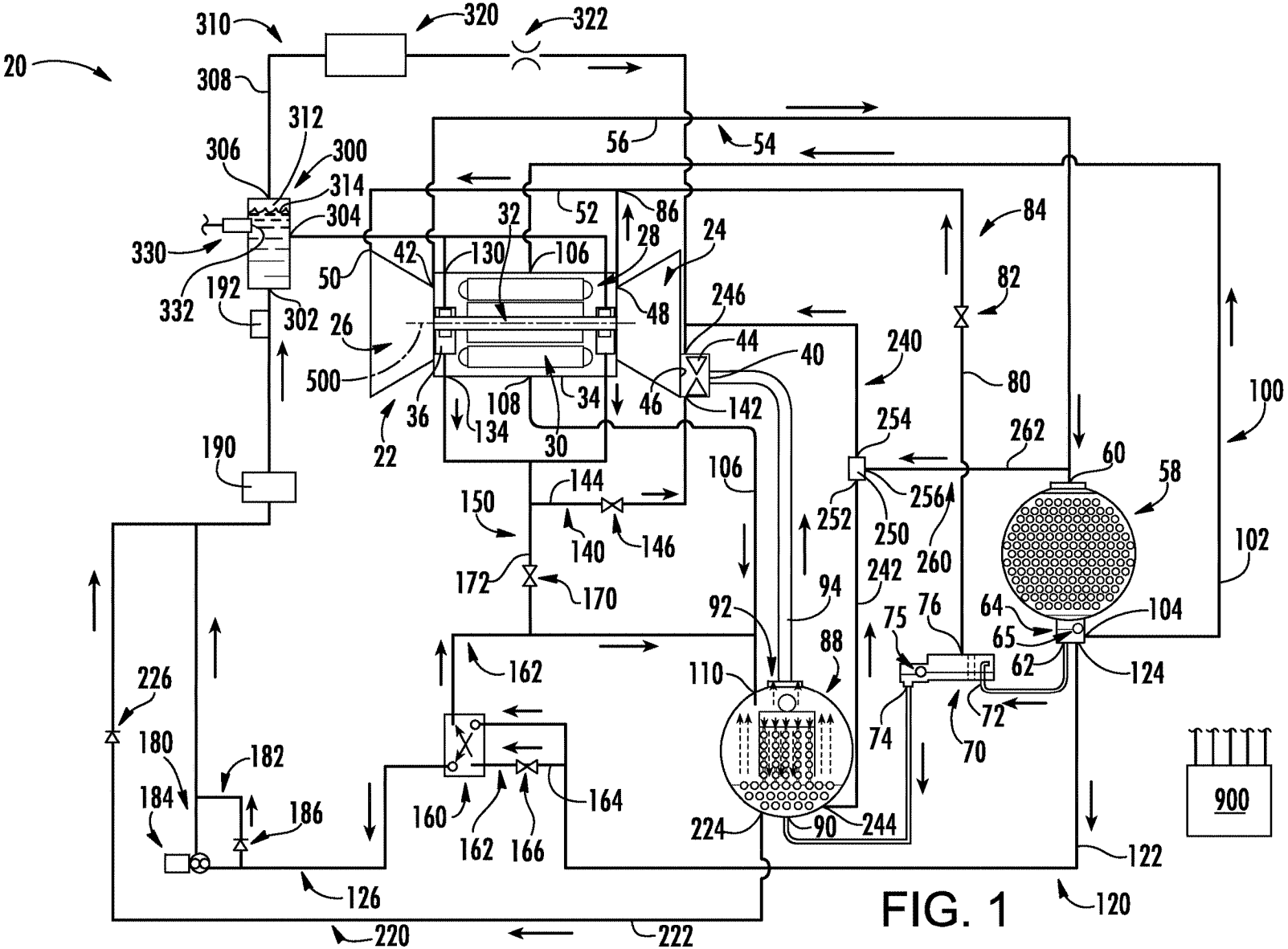
FIG. 1 is a schematic view of a vapor compression system in a first mode of operation.

FIG. 1 shows a vapor compression system 20. This reflects details of one particular baseline system. Other systems may be subject to similar modifications to add a liquid sensor or replace a baseline liquid sensor. FIG. 1 shows flow arrows (and thus associated valve conditions) associated with operating conditions that may correspond to a startup condition or, generally, a condition where there is a low pressure difference between condenser and evaporator. Other operating conditions are discussed further below. The exemplary system 20 is a chiller having a compressor 22 driving a recirculating flow of refrigerant. The exemplary compressor is a two-stage centrifugal compressor having a first stage 24 and a second stage 26. Impellers of the two stages are co-spooled and directly driven by an electric motor 28 having a stator 30 and a rotor 32. The compressor has a housing or case 34 supporting one or more bearings 36 to in turn support the rotor 32 for rotation about its central longitudinal axis 500 forming a central longitudinal axis of the compressor. As is discussed further below, the bearings are rolling element bearings with one or more circumferential arrays of rolling elements radially sandwiched between an inner race on the rotor (e.g., mounted to a shaft) and an outer race on the housing (e.g., press fit into a bearing compartment). Exemplary rolling elements include balls, straight rollers (e.g., including needles), and tapered rollers. Exemplary bearings are hybrid bearings with steel races and ceramic rolling elements. Exemplary ceramic rolling elements are silicon nitride ceramic balls. Exemplary races are 52100 bearing steel rings and high nitrogen CrMo martensitic steel rings, including Bolder N360 (trademark of BÖHLER Edelstahl GmbH & Co KG, Kapfenberg, Austria) and Cronidur 30 (trademark of Energietechnik Essen GmbH, Essen, Germany).

As is discussed further below, the exemplary vapor compression system 20 is an essentially oil or lubricant-free system. Accordingly, it omits various components of traditional oil systems such as dedicated oil pumps, oil separators, oil reservoirs, and the like. However, a very small amount of oil or other material that may typically be used as a lubricant may be included in the overall refrigerant charge to provide benefits that go well beyond the essentially non-existent amount of lubrication such material would be expected to provide. As is discussed further below, a small amount of material may react with bearing surfaces to form protective coatings. Accordingly, even though traditional oil-related components may be omitted, additional components may be present to provide refrigerant containing the small amounts of material to the bearings. In discussing this below, terms such as "oil-rich" may be used. Such terms are understood as used to designate conditions relative to other conditions within the present system. Thus, "oil-rich" as applied to a location in the FIG. 1 system may be regarded as extremely oil-depleted or oil-free in a traditional system.

The exemplary compressor has an overall inlet (inlet port or suction port) 40 and an overall outlet (outlet port or discharge port) 42. In the exemplary configuration, the outlet 42 is an outlet of the second stage 26. The inlet 40 is upstream of an inlet guide vane array 44 which is in turn upstream of the first stage inlet 46. The first stage outlet 48 is coupled to the second stage inlet 50 by an interstage line (interstage) 52. Although inlet guide vanes (IGVs) are shown only for the first stage, alternative implementations may additionally or alternatively have IGVs for the second stage. In such cases, the line 240 could go to the second stage. Another variation is a single stage compressor with inlet guide vanes.

As is discussed further below, additional flows of refrigerant may exit and/or enter the compressor at additional locations. From the discharge port 42, a main refrigerant flowpath 54 proceeds downstream in a normal operational mode along a discharge line 56 to a first heat exchanger 58. In the normal operational mode, the first heat exchanger is a heat rejection heat exchanger, namely a condenser. The exemplary condenser is a refrigerant-water heat exchanger wherein refrigerant passes over tubes of a tube bundle which carry a flow of water (or other liquid). The condenser 58 has one or more inlets and one or more outlets. An exemplary primary inlet is labeled 60. An exemplary primary outlet is labeled 62. An exemplary outlet 62 is an outlet of a sump 64 at the base of a vessel of the condenser 58. An outlet float valve assembly 65 may include an orifice at the outlet 62 to serve as an expansion device. Additional sump outlets are shown and discussed below.

The exemplary system 20 is an economized system having an economizer 70 downstream of the condenser along the flowpath 54. The exemplary economizer is a flash tank economizer having an inlet 72, a liquid outlet 74, and a vapor outlet 76. In the exemplary implementation, the vapor outlet 76 is connected to an economizer line 80 defining an economizer flowpath 84 as a branch off the main flowpath 54 returning to an economizer port 86 of the compressor which may be at the interstage (e.g., line 52). A control valve 82 (e.g., an on-off solenoid valve may be along the economizer line. An outlet float valve assembly 75 may include an orifice at the liquid outlet 74 to serve as an expansion device. The main flowpath 54 proceeds downstream from the economizer liquid outlet 74 to an inlet 90 of a second heat exchanger 88. The exemplary heat exchanger 88 is, in the normal operational mode, a heat absorption heat exchanger (e.g., evaporator). In the exemplary chiller implementation, the evaporator 88 is a refrigerant-water heat exchanger which may have a vessel and tube bundle construction wherein the tube bundle carries the water or other liquid being cooled in the normal operational mode. For simplicity of illustration, FIG. 1 omits details including the inlet and outlet for the flows of water or other heat transfer fluid. The evaporator has a main outlet 92 connected to a suction line 94 which completes the main flowpath 54 returning to the inlet 40.

Several additional optional flowpaths and associated conduits and other hardware are shown branching off from and returning to the main flowpath 54. In addition to the economizer flowpath 84, a motor cooling flowpath 100 also branches off from and returns to the flowpath 54. The exemplary motor cooling flowpath 100 includes a line 102 extending from an upstream end at a port 104 on some component along the main flowpath (shown as the sump 64). The line 102 extends to a cooling port 106 on the compressor. The motor cooling flowpath passes through the port 106 into a motor case of the compressor. In the motor case, the cooling flow cools the stator and rotor and then exits a drain port 108. Along the flowpath 100, a motor cooling return line 109 returns the flow from the port 108 to the main flowpath. In this example, it returns to a port 110 on the vessel of the evaporator 88.

A more complicated optional system of branch flowpaths may be associated with bearing lubrication. A trunk 120 of a bearing supply flowpath is formed by a line 122 extending from a port 124 located along the main flowpath (e.g., at the sump 64). A branch flowpath 126 ultimately passes to one or more ports 130 on the compressor communicating refrigerant to respective associated bearings 36. One or more ports 134 extend from one or more drains at the bearings to return refrigerant to the main flowpath. In this embodiment, two possible return paths are shown. A first return path or branch 140 passes to a port 142 immediately downstream of the inlet guide vane array 44. This port 142 is at essentially the lowest pressure condition in the system and thus provides the maximum suction for drawing refrigerant through the bearings. A valve 146 may be along a line 144 along this flowpath branch. The exemplary valve 146 is an electronically controlled on-off valve (e.g., a solenoid valve) under control of a system controller. A second bearing return flowpath/branch 150 is discussed below.

Several additional optional features relating to refrigerant supply to the bearing are shown. A subcooler 160 may be provided to cool refrigerant passing to the bearings. The exemplary subcooler 160 is a heat exchanger that receives flow passing along the flowpath 126 and transfers heat from that refrigerant flow to a refrigerant flow passing along a branch 162. The exemplary branch 162 branches off directly or indirectly from the main flowpath. In the illustrated embodiment, the branch 162 branches off from the flowpath 120 leaving the branch 126. In alternative implementations, the branch 162 may be fully separate from the flowpath 120 back to the condenser 58. The branch 162 passes through a subcooler supply line 164 in which an expansion device 166 (e.g., an expansion valve) is located. Expanded refrigerant enters a subcooler inlet of the subcooler 160 and exits a subcooler outlet. In the subcooler 160, the expanded refrigerant absorbs heat from refrigerant passing along the branch 126 which has entered a main inlet and then exits a main outlet. The exemplary subcooler 160 is a brazed plate heat exchanger. The flowpath 162 returns to the main flowpath. In the exemplary embodiment, the flowpath 162 merges with the flowpath along line 109 and enters the port 110 on the heat exchanger 88. Alternatively, line 164 can come directly from the condenser independently of line 122 and its associated flowpath. Alternatively, line 162 can drain directly into the evaporator 88 independently of line 109 and its associated flow path.

As noted above, FIG. 1 also shows a second bearing drain flowpath branch 150. The exemplary flowpath branch 150 joins the flowpath 162 downstream of the subcooler and upstream of the junction with the line 109. A valve 170 (e.g., similar to 146) is located in a line 172 along the flowpath 150 to control flow. In an exemplary FIG. 1 condition, the valve 170 is closed blocking flow along the branch 150.

FIG. 1 shows further details of exemplary flowpath 126. The flowpath 126 further branches into a branch 180 and a parallel branch 182 which then remerge. A pump 184 is located along the branch 180 and a one-way check valve 186 located along the branch 182. In the normal FIG. 1 operating condition, pressure is sufficient to drive flow downstream through the valve 186. Accordingly, the pump 184 is not used. If pressure is insufficient (discussed below) the pump 184 may be turned on to drive refrigerant flow for bearing supply.

The flowpath 126 proceeds downstream through a filter 190 prior to entering the ports 130. FIG. 1 also shows a temperature sensor 192 downstream of the filter 190 for measuring temperature of refrigerant entering the compressor for bearing cooling.

FIG. 1 further shows yet another branch 220 for bearing cooling. The exemplary branch 220 bypasses both the optional subcooler and the pump before rejoining the branch flowpath 126 upstream of the filter 90. The exemplary branch 220 passes along a line 222 extending from a port 224 on the evaporator and passes through a check valve 226 which may be similar to the check valve 186.

FIG. 1 further shows a bypass flowpath or branch 240 for returning refrigerant to the compressor. A line 242 is along the flowpath from an upstream end at a port 244 on the evaporator 88 to a downstream end at a port 246 in similar location to the port 142 downstream of the inlet guide vane array 44. This may be used to deliver a relative oil-rich flow of refrigerant back to the compressor. Specifically, oil may tend to concentrate in liquid refrigerant in a lower portion of the evaporator. Because the port 244 may be positioned at such a location to deliver oil-rich refrigerant directly to the bearings, flow along the flowpath 240 delivers the oil rich mixture into the compressing flow which, in turn, passes to the condenser 58 and may thus increase the amount of oil available in the flow along the flowpath 120. Pressure difference between the ports 244 and 246 alone may be insufficient to drive this flow. Accordingly, an eductor 250 or similar pump may be located along the line 242. The eductor has a suction port or inlet 252 upstream and a discharge port or outlet 254 downstream. A motive flow inlet 256 receives flow along a branch flowpath 260 associated with a branch line 262. The exemplary branch line 262 and flowpath 260 branch off the main flowpath at essentially compressor discharge conditions (e.g., from upstream of the condenser inlet 60 or from the headspace of the condenser).

FIG. 1 shows a degas tank 300 along the bearing supply line and flowpath 126. The tank has an inlet 302 for receiving liquid refrigerant (e.g., downstream of the filter 190). The exemplary inlet 302 is at a bottom of the tank. The exemplary tank is a cylindrical metallic tank oriented with its axis vertically. An exemplary refrigerant outlet 304 is along a sidewall of the tank. An additional port 306 on the tank is connected to a vacuum line 308 and associated flowpath 310 (a branch off the bearing supply flowpath) to draw vapor from the headspace 312 of the tank. The exemplary line 308 and flowpath 310 extend to a low pressure location in the system. An exemplary low pressure location is downstream of the inlet guide vanes such as the port 142, port 146, or a similar dedicated port. Other low pressure locations within the compressor (bypassing the compressor inlet) or along the main flowpath upstream of the compressor inlet may be used. Similarly, the refrigerant supply flowpath may branch off the main flowpath at any of several locations appropriate for the particular system configuration. Along the line 308 and flowpath 310, FIG. 1 also shows an exemplary strainer 320 and orifice 322. The orifice functions to limit flow rate to avoid drawing liquid from the degas tank. FIG. 1 shows a single sensor for both refrigerant supplies. Alternatively, separate sensor assemblies may be provided for individual bearing refrigerant supply lines.

FIG. 1 further shows a liquid level sensor 330 mounted to the tank. The exemplary liquid level sensor 330 is mounted above the ports 302 and 304. An exemplary mounting is by a height of at least 25 mm (or at least 30 mm or 25 mm to 50 mm or 30 mm to 40 mm) above the outlet port 304 (i.e., the central axis 520 of the sensor is spaced by that much above the upper extremity of the outlet port). The sensor may be oriented horizontally (e.g., with the axis of its cylindrical body and its prism) within about 10° or 5° of horizontal) to avoid trapping of bubbles by the sensor. Thus, the line 308 and flowpath 310 withdraw vapor from above the sensor 330. Although these are shown extending extend from the bearing supply flowpath directly back to the compressor (instead of rejoining the main flowpath upstream of the suction port), other low-pressure destinations might be used.

A number of types and configurations of liquid level sensors exist. The exemplary sensor is an optical sensor as discussed below. The sensor has an operative/sensing end 332 positioned to be exposed to the liquid in a normal situation of sufficient liquid. In this example, the sensor is an optical sensor and the exposure is an optical exposure which may, however, also include physical exposure with the end 332 contacting the fluid (liquid refrigerant and/or vapor) in the tank. The sensor 330 may be used to determine whether the liquid surface 314 has descended below a critical level (whereafter further descent might risk vapor passing through the port 304 and being ingested by the bearings). The determination of the surface 314 descending to this threshold height may trigger a response by the controller 900. Exemplary responses may include compressor shutdown or may include some form of remedial activity.

Figure 3:
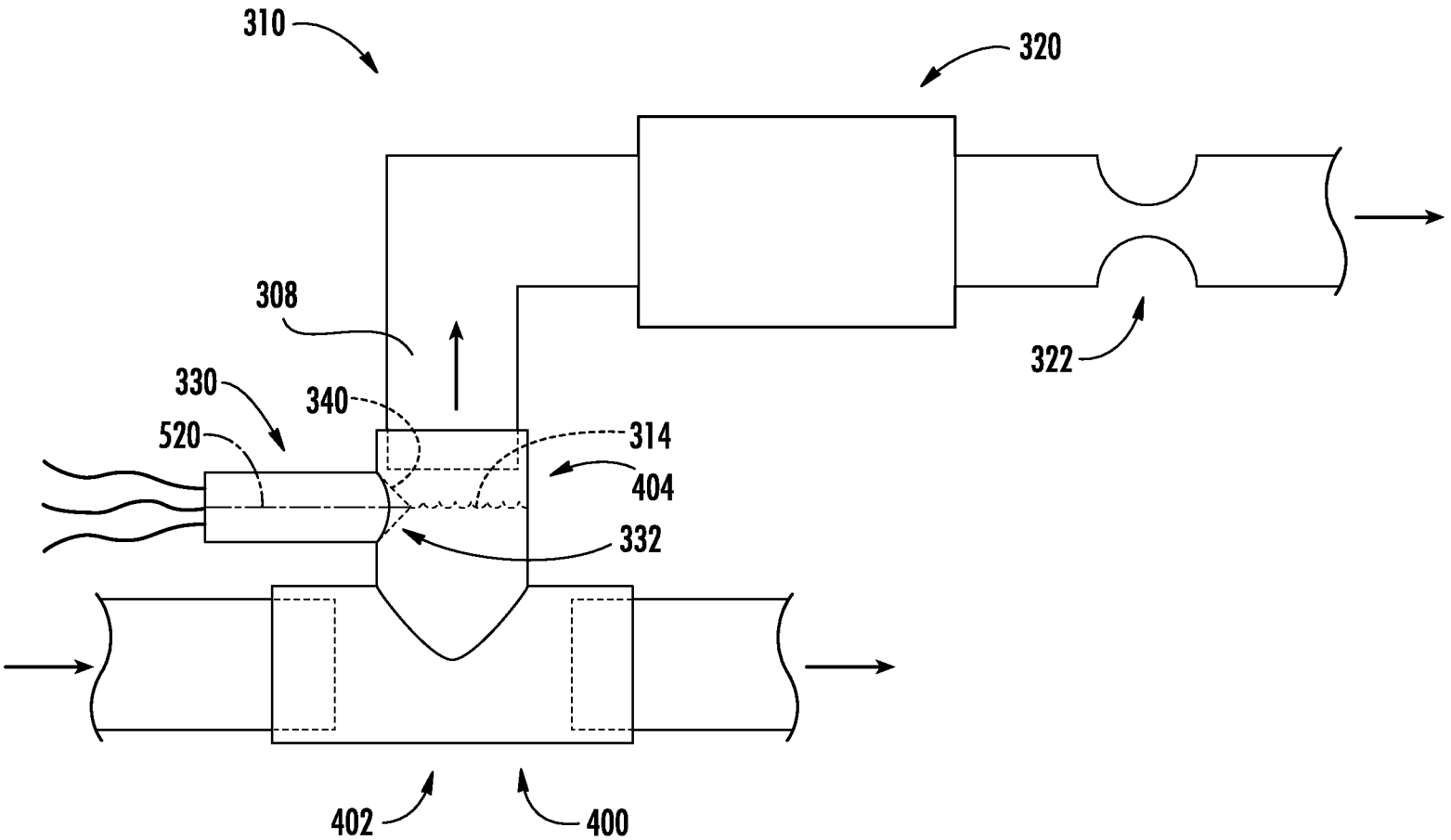
FIG. 3 is a partially schematic view of a liquid level sensor in a vapor compression system.

FIG. 3 shows an alternative configuration wherein a T-fitting 400 is placed with its head 402 (alternatively phrased as arms) along the bearing supply line/flowpath. The leg 404 of the T extends upward to form a small degas tank. The sensor 330 is mounted to a side of the tank. FIG. 3 shows the operative end 332 of the sensor as being formed by a prism 340. Again, the sensor is oriented sideways or horizontally (e.g., with its axis within about 10° or 5° of horizontal or of parallel to the head of the T) spaced above the flowpath 126 (i.e. above the local upper extremity along the arms of the T) by a height such as a least 25 mm (or at least 30 mm or 25 mm to 50 mm or 30 mm to 40 mm).

Figure 2:
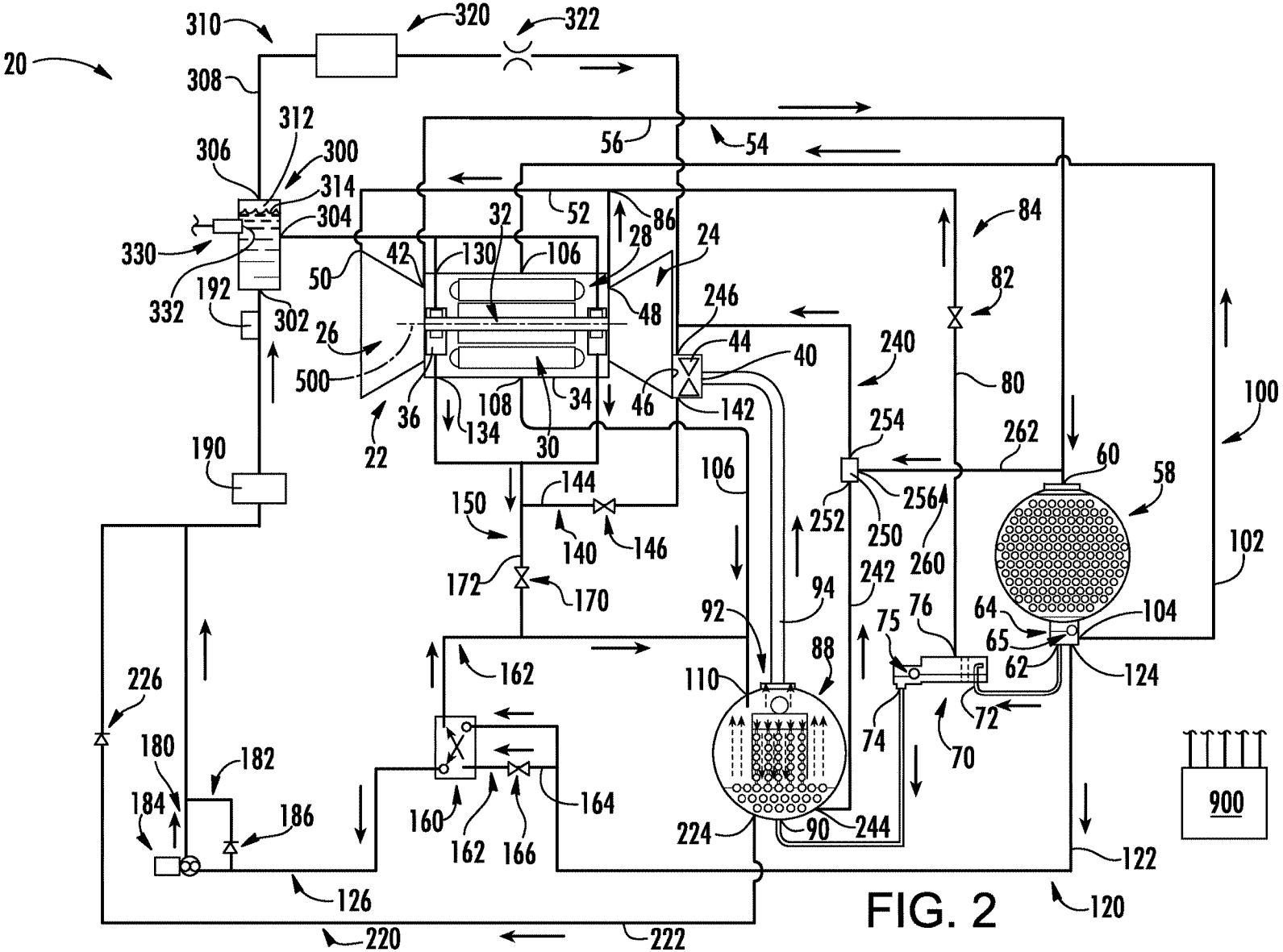
FIG. 2 is a schematic view of the system in a second mode of operation.

The exemplary sensor of FIGS. 1-3 is a switch positioned to change state when the liquid level transits a certain threshold height relative to the prism 340. The exemplary liquid level switch is configured to have a closed condition associated with a sufficient liquid exposure (although an open condition version may alternatively be used). An exemplary threshold is approximately halfway up the prism.

FIG. 2 shows flow arrows associated with a normal operational mode (e.g., with high pressure difference between condenser and evaporator). Yet other modes are possible and may be dependent upon other system details or modifications thereof (e.g., a defrost dehumidification mode where one heat exchanger is a refrigerant-air heat exchanger or possible other modes where the functions of the two heat exchangers become reversed).

The overall circulating refrigerant mixture may comprise: one or more base refrigerants or refrigerant bases (e.g., discussed below); optionally a small amount of an oil material that might normally be regarded as a lubricant; optionally, further additives; and contaminants, if any.

Exemplary base refrigerant can include one or more hydrofluoroolefins, hydrochloroolefins, and mixtures thereof (e.g., including hydrochloroflouroolefins). Below HFO is used to synonymously refer to all three of these refrigerant types. Exemplary hydrochloroflouroolefins include chloro-trifluoropropenes. Exemplary chloro-trifluoropropenes, are 1-chloro-3,3,3-trifluoropropene and/or 2-chloro-3,3,3-trifluoropropene, and most particularly trans-1-chloro-3,3,3-trifluoropropene (E-HFO-1233zd, alternatively identified as R1233zd(E)). The hydrofluoroolefins can be a C3 hydrofluoroolefin containing at least one fluorine atom, at least one hydrogen atom and at least one alkene linkage. Exemplary hydrofluoroolefins include 3,3,3-trifluoropropene (HFO-1234zf), E-1,3,3,3-tetrafluoropropene, (E-HFO-1234ze), Z-1,3,3,3-tetrafluoropropene (Z-HFO-1234ze), 2,3,3,3-tetrafluoropropene (HFO-1234yf), E-1,2,3,3,3-pentafluoropropene (E-HFO-1255ye), Z-1,2,3,3,3-pentafluoropropene (Z-HFO-125ye).

Exemplary oils are polyol ester (POE) oils. Other possible oils include polyalkylene glycols (PAG), polyvinyl ethers (PVE), alkylbenzenes, polyalpha olefins, mineral oils, and the like as well as mixtures. A relevant consideration is the availability of hydrocarbons that can form an organic protective layer on the bearing surfaces.

The trace polyol ester oil (100 ppm) may particularly be of the hindered type excellent in thermal stability. The polyol ester oil is obtained from the condensation reaction between polyhydric alcohols and monohydric fatty acids (e.g., medium molecular weight (C5-C10)). Particular examples of polyhydric alcohols include neopentyl glycol, trimethylolethane, trimethylolpropane, trimethylolbutane, pentaerythritol, dipentaerythritol, and higher polyether oligomers of pentaerythritol, such as tripentaerythritol and tetrapentaerythritol. Polyol esters can be formed from monohydric fatty acids including n-pentanoic acid, n-hexanoic acid, n-heptanoic acid, n-octanoic acid, 2-methylbutanoicacid, 2-methylpentanoic acid, 2-methylhexanoic acid, 2-ethylhexanoic acid, isooctanoic acid, 3,5,5-trimethylhexanoic acid.

The additives may comprise a wide range of functionalities, including: extreme pressure agents; acid capturing agents; defoamers; surfactants; antioxidants; corrosion-inhibitors; plasticizers; metal deactivating agents. These may comprise a wide range or chemistries including: epoxides; unsaturated hydrocarbons or unsaturated halocarbons; phthalates; phenols; phosphates; perfluoropolyethers; thiols; phosphites; siloxanes; tolytriazoles; benzotriazoles; amines; zinc dithiophosphates; and amine/phosphate ester salts. Exemplary individual additive concentrations are no more than 1.0% by weight, more particularly 10 ppm to 5000 ppm or no more than 1000 ppm or no more than 200 ppm. Exemplary aggregate non-oil additive concentrations are no more than 5.0% by weight, more particularly, no more than 2.0% or no more than 1.0% or no more than 5000 ppm or no more than 1000 ppm or no more than 500 ppm or no more than 200 ppm or no more than 100 ppm.

FIG. 1 further shows a controller 900. The controller may receive user inputs from an input device (e.g., switches, keyboard, or the like) and sensors (not shown, e.g., pressure sensors, temperature sensors, and/or flow sensors (e.g. particularly measuring flow to the bearings) at various system locations). The controller may be coupled to the sensors and controllable system components (e.g., valves, the bearings, the compressor motor, vane actuators, and the like) via control lines (e.g., hardwired or wireless communication paths). The controller may include one or more: processors; memory (e.g., for storing program information for execution by the processor to perform the operational methods and for storing data used or generated by the program(s)); and hardware interface devices (e.g., ports) for interfacing with input/output devices and controllable system components.

The system may be made using otherwise conventional or yet-developed materials and techniques.

The use of "first", "second", and the like in the description and following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing basic system, details of such configuration or its associated use may influence details of particular implementations. Accordingly, other embodiments are within the scope of the following claims.

What is claimed is:

1. A vapor compression system comprising:
a compressor (22) comprising:
an inlet (40) and an outlet (42); and
an electric motor (28) having:
a stator (30); and
a rotor (32); and
a plurality of bearings (36) supporting the rotor;
a fluid flowpath (126) to the plurality of bearings;
a branch (310) branching off from the fluid flowpath; and
a liquid sensor (330) along the branch spaced locally above the fluid flowpath, wherein:
the liquid sensor is mounted along the leg of a T-fitting and the fluid flowpath passes through first and second arms of a head of the T-fitting.

2. The vapor compression system of claim 1 wherein:
the liquid sensor (330) is an optical sensor.

3. The vapor compression system of claim 1 wherein:
the liquid sensor (330) has a glass prism (340) exposed to fluid along the branch.

4. The vapor compression system of claim 1 wherein:
the branch (310) extends from the fluid flowpath directly back to the compressor.

5. The vapor compression system of claim 1 wherein:
the liquid sensor (330) is mounted centered at least 25 mm above an outlet of the second arm of the T-fitting.

6. The vapor compression system of claim 1 wherein:
the liquid sensor (330) is mounted generally horizontally.

7. The vapor compression system of claim 1 wherein:
the liquid sensor (330) is a liquid level switch.

8. The vapor compression system of claim 7 wherein:
the liquid level switch (330) is configured to have a closed condition associated with a sufficient liquid exposure.

9. The vapor compression system of claim 1 wherein:
the compressor is a centrifugal compressor comprising an impeller; and
the branch extends to upstream of the impeller.

10. The vapor compression system of claim 9 wherein:
the compressor comprises inlet guide vanes (44); and
the branch extends to downstream of the inlet guide vanes.

11. The vapor compression system of claim 1 further comprising:
a condenser (58);
an evaporator (88);
a suction line (94) along a flowpath between the evaporator and an inlet of a first stage (24) of the compressor;
a flowpath leg from a discharge (48) of the first stage to a second stage (26) inlet (50); and
a discharge line (56) along a flowpath between a discharge (42) of the second stage and an inlet (60) of the condenser.

12. The vapor compression system of claim 1 wherein a refrigerant charge of the system is one or more of:
essentially oil-free; and
at least 50% by weight trans 1-chloro, 3,3,3-fluoropropene (R1233zd(E)).

13. The vapor compression system of claim 1 lacking an oil reservoir.

14. A method for using the system of claim 1, the method comprising:
running the compressor;
passing fluid along the fluid flowpath to the bearings; and
responsive to an insufficiency of liquid detected by the liquid sensor, shutting down the compressor.

15. The method of claim 14 further comprising:

during the running, drawing vapor out of the fluid flowpath to the bearings, the drawing being along the branch.

16. The method of claim 14 wherein:

the compressor is a centrifugal compressor comprising an impeller; and the branch extends to upstream of the impeller.

17. A vapor compression system comprising a compressor (22), the compressor comprising:

an inlet (40) and an outlet (42); and an electric motor (28) having:

a stator (30); and a rotor (32);

a plurality of bearings (36) supporting the rotor;

a fluid flowpath (126) to the plurality of bearings;

a T-fitting (404) having:

a head along the fluid flowpath, the fluid flowpath passing into an inlet in one arm of the head and out of a liquid outlet in the other arm of the head; and a leg forming a vapor outlet with a flowpath branch from the vapor outlet passing directly back to the compressor; and a liquid sensor (330) mounted on the leg of the T-fitting spaced locally above the flowpath.

18. The vapor compression system of claim 17 wherein:

the compressor comprises inlet guide vanes (44); and the branch extends to downstream of the inlet guide vanes.

19. The vapor compression system of claim 17 wherein:

the liquid sensor (330) is a liquid level switch.

20. A vapor compression system comprising a compressor (22), the compressor comprising:

an inlet (40) and an outlet (42); and an electric motor (28) having:

a stator (30); and a rotor (32);

a plurality of bearings (36) supporting the rotor;

a fluid flowpath (126) to the plurality of bearings;

a liquid sensor (330); and means (310) for withdrawing vapor from above the liquid sensor, said means comprising a T-fitting with an upwardly-extending leg and a head, the fluid flowpath passing through first and second arms of the head and the withdrawn vapor passing from the upwardly-extending leg.

21. A vapor compression system comprising a compressor, the compressor comprising:

an inlet and an outlet and an electric motor having:

a stator; and a rotor;

a plurality of bearings supporting the rotor;

a fluid flowpath to the plurality of bearings;

a liquid sensor; and means for concentrating vapor proximate the sensor to improve effective sensor sensitivity, said means comprising a T-fitting with an upwardly-extending leg and a head, the fluid flowpath passing through first and second arms of the head.

22. A vapor compression system comprising a compressor, the compressor comprising:

an inlet and an outlet;

an impeller; and an electric motor having:

a stator; and a rotor;

a plurality of bearings supporting the rotor;

a fluid flowpath passing through first and second arms of a head of a T-fitting to the plurality of bearings;

a branch branching off from the fluid flowpath, the branch passing through the leg of the T-fitting and bypassing the bearings and extending to upstream of the impeller; and a liquid sensor along the branch.

* * * * *